United States Patent [19]

Bigelow et al.

[11] Patent Number: 4,673,044

[45] Date of Patent: Jun. 16, 1987

[54] EARTH BORING BIT FOR SOFT TO HARD FORMATIONS

[75] Inventors: Louis K. Bigelow, Salt Lake City; Richard H. Grappendorf, Riverton; Alexander R. Meskin, Salt Lake City, all of Utah

[73] Assignee: Eastman Christensen Co., Salt Lake City, Utah

[21] Appl. No.: 761,915

[22] Filed: Aug. 2, 1985

[51] Int. Cl.[4] ..... E21B 10/18; E21B 10/50

[52] U.S. Cl. ..... 175/329; 175/339; 175/410

[58] Field of Search ..... 175/329, 330, 409, 411, 175/374, 375, 339, 410

[56] References Cited

U.S. PATENT DOCUMENTS

| | | | |
|---|---|---|---|
| 3,127,946 | 4/1964 | Deely | 175/330 |
| 3,215,215 | 11/1965 | Kellner | 175/330 |
| 3,938,599 | 2/1976 | Horn | 175/329 |
| 4,207,954 | 6/1980 | Jerome | 175/330 |
| 4,244,432 | 1/1981 | Rowley et al. | 175/329 |
| 4,491,188 | 1/1985 | Grappendorf | 175/330 |
| 4,499,959 | 2/1985 | Grappendorf et al. | 175/330 |
| 4,515,226 | 5/1985 | Mengel et al. | 175/410 |
| 4,529,047 | 7/1985 | Meskin et al. | 175/410 |
| 4,586,574 | 5/1986 | Grappendorf | 175/410 |

*Primary Examiner*—Stephen J. Novosad
*Assistant Examiner*—Terry Lee Melius
*Attorney, Agent, or Firm*—Beehler, Pavitt, Siegemund, Jagger, Martella & Dawes

[57] ABSTRACT

A drill bit having thermally stable PCD cutting elements includes a matrix body element having a plurality of spaced cutting elements supported in a body of matrix material such that a substantial portion of the cutter is above the body matrix and a minor portion is received within the body matrix. The cutters have side surfaces exposed and are so positioned that at least in some of the cutters more surface area of one side face is exposed as compared to the other side faces. The cutter support may include a small pad of matrix material to reduce the loading directly on the PCD. In a preferred form the PCD elements are mounted on pads or blades formed by spaced channels. The hydraulics are straight radial flow and improved hydraulic flow is achieved through the use of waterways which concentrate the fluid flow near the face of the cutters. In one form, improved hydraulics are obtained by having one fluid discharge port for each of the radially disposed fluid channels. Various forms and arrangements are disclosed.

22 Claims, 21 Drawing Figures

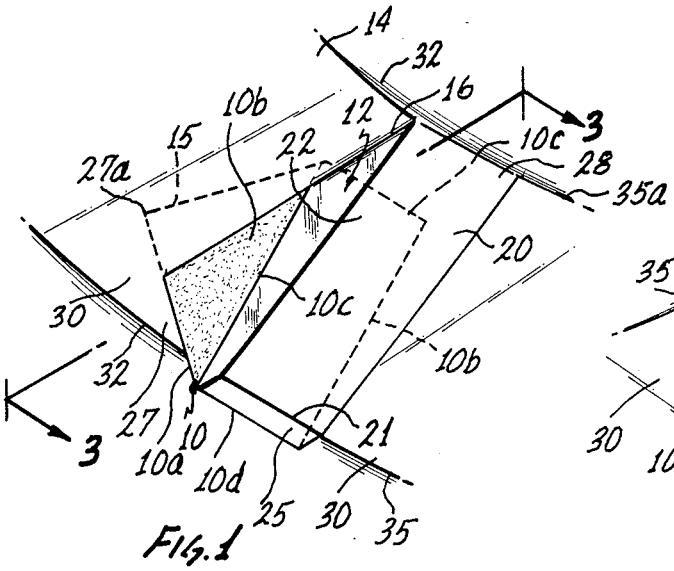
Fig. 1
Fig. 2
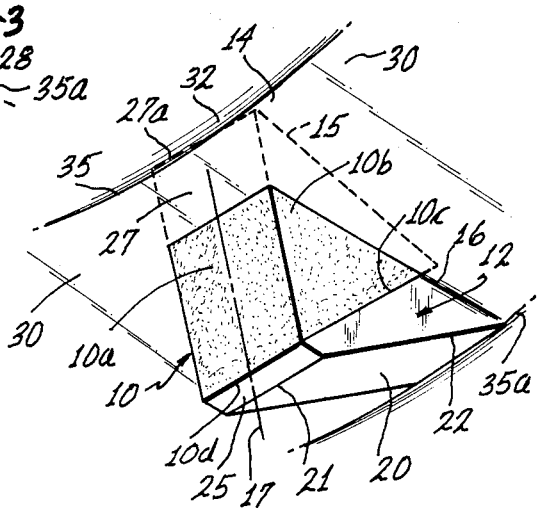
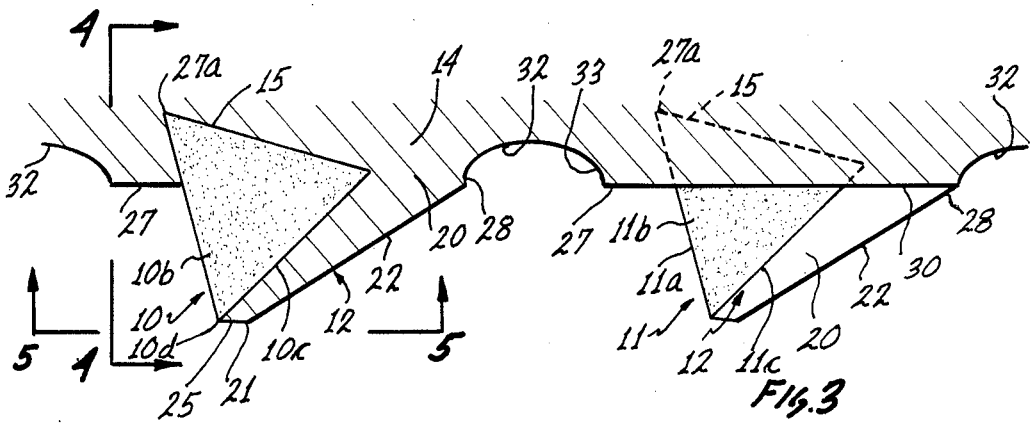
Fig. 3
Fig. 4
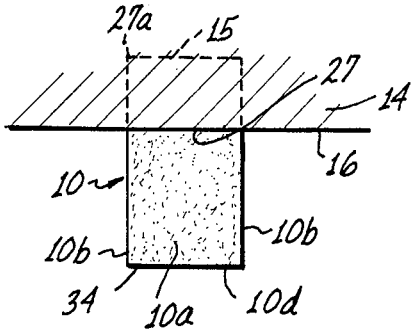
Fig. 5
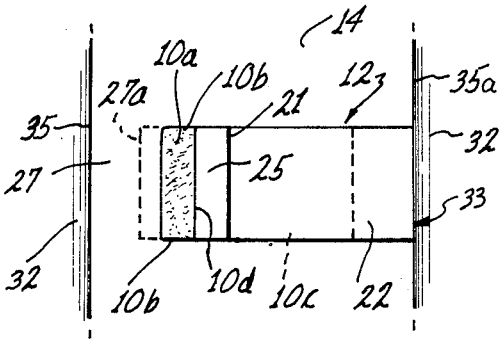

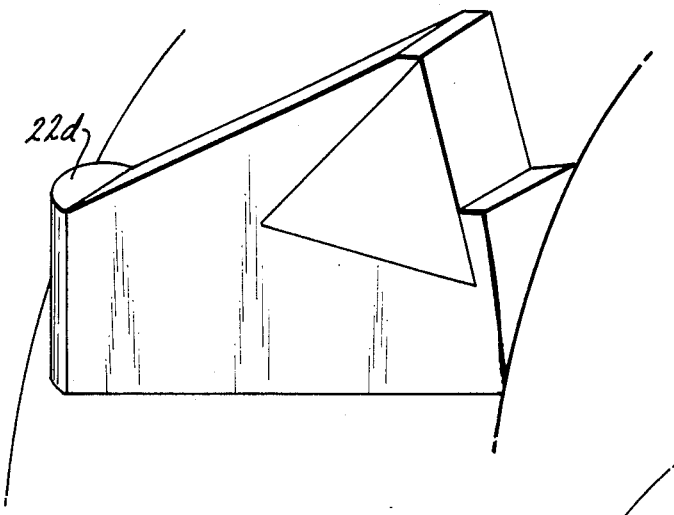
Fig. 13a
Fig. 13b
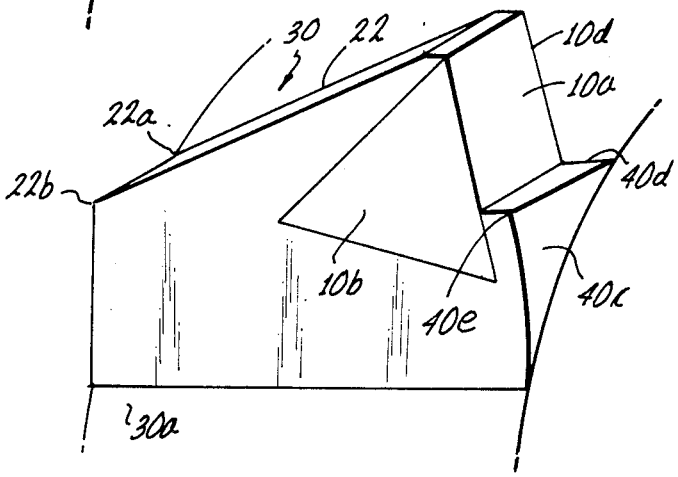
Fig. 20
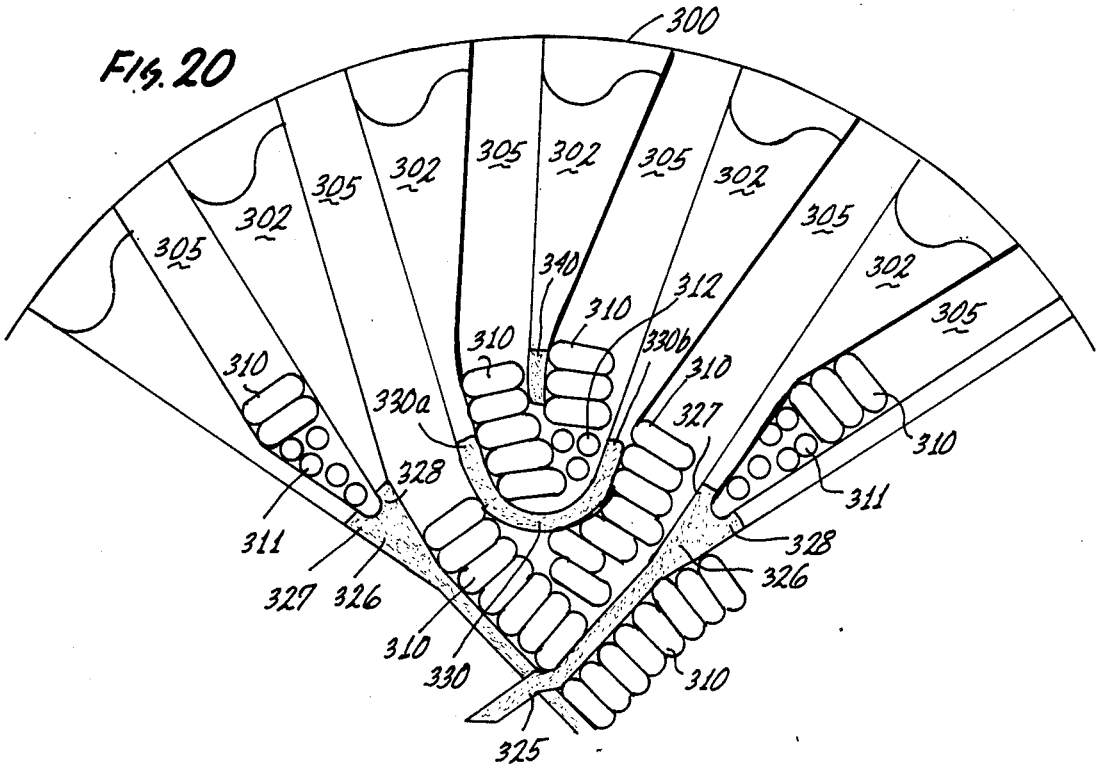

EARTH BORING BIT FOR SOFT TO HARD FORMATIONS

FIELD OF THE INVENTION

The present invention relates to the field of earth boring bits, and more particularly to an improved earth boring bit having temperature stable polycrystalline diamond elements as the cutting elements, and adapted to be used in soft to medium hard formations and typically those which are more abrasive than pure shale and pure mudstone, for example.

DESCRIPTION OF THE PRIOR ART

The use of diamonds in drilling and earth boring products is well known. More recently, synthetic diamonds, both single crystal diamonds (SCD) and polycrystalline diamonds (PCD) have become commercially available from various sources and have been used in such products, with recognized advantages. For example, natural diamond bits effect drilling with a plowing action in comparison to crushing in the case of a roller cone bit, whereas PCD elements tend to cut by a shearing action. In the case of rock formations, for example, it is believed that less energy is required to fail the rock in shear than in compression.

In addition to natural diamond, tungsten carbide (WC) elements have been used as cutting elements in drill bits for use in oil and gas drilling. Tungsten carbide, however, does not possess the hardness nor the abrasion resistance of natural or synthetic diamond materials; the latter having a greater hardness and a noticeably greater abrasion resistance than WC. Even though WC cutting elements may be fabricated in various geometrical shaped, and may be less expensive than natural or synthetic diamond material, the overall performance of the same may not be comparable to natural or synthetic diamond material. A typical patent showing the use of WC cutting elements is U.S. Pat. No. 4,190,126 issued to Kabashima. As illustrated in this patent, the cutting element is essentially below the face of the bit, with little cutter exposure above the face; further the matrix is soft in comparison to the WC cutter in order to expose the same during use.

More recently, a variety of synthetic diamond products has become available commercially, some of which are available as polycrystalline products. Single crystal diamonds preferentially fracture on (111), (110) and (100) planes, whereas PCD tends to be isotropic and exhibits this same cleavage but on a microscale and therefore resists catastrophic large scale cleavage failure. The result is a retained sharpness which appears to resist polishing and aids in cutting, provided the synthetic material is properly mounted in a correct orientation in the body material. This proper orientation has not yet been discussed generally in the prior art except that of the present assignee, as will be discussed. Such synthetic diamond products are described, for example, in U.S. Pat Nos. 3,913,280; 3,745,623; 3,816,085; 4,104,344 and 4,224,380, to mention only a few.

In general, the PCD products are fabricated from synthetic and/or appropriately sized natural diamond crystals under heat and pressure and in the presence of a solvent/catalyst to form the polycrystalline structure. In one form of product, the polycrystalline structures include sintering aid material distributed essentially in the interstices where adjacent crystals have not bonded together.

In another form, as described for example in U.S. Pat. Nos. 3,745,623; 3,816,085; 3,913,280; 4,104,223 and 4,224,380 the resulting diamond sintered product is porous, porosity being acheived by dissolving or leaching out all or part of the nondiamond material, as disclosed, for example in U.S. Pat. Nos. 4,104,344 and 4,224,380. For convenience, such a material may be described as porous PCD, as referenced in U.S. Pat. No. 4,224,380. Porous PCD tends to be temperature stable, as will be discussed, but temperature stability as that term is used in this invention may be achieved by other mechanisms as is known in the art, for example, by control of the type or amount of inclusions, such that it is not necessary for the product to be porous in order to be temperature stable.

Polycrystalline diamonds have been used in earth boring products either as individual elements or as relatively thin PCD tables supported on a cemented tungsten carbide (WC) support backing. In one form, the PCD table is supported on a cylindrical tungsten carbide slug about 13.3 mm in diameter and about 3 mm long, with a PCD table of about 0.5 to 0.6 mm in cross-section on the face of the cutter. In another version, a stud cutter, the PCD table is also supported by a cylindrical substrate of tungsten carbide of about 3 mm by 13.3 mm in diameter, backed by a tungsten carbide backing such that the entire length is about 26 mm, and the backing and the substrate and the table are essentially in axial alignment. The various forms of supported PCD table faced cutters have been used in oil and gas drilling products intended for use in soft to medium hard formations, see for example, U.S. Pat. Nos. 4,200,159 and 4,244,432.

Individual PCD elements of various geometrical shapes have been used in place of natural diamonds in certain applications in oil and gas, mining, and construction drilling products, and mounted in much the same fashion as natural diamond. However, certain problems arose with PCD elements used as individual pieces of a given carat size or weight. In general, natural diamond, available in a wide variety of shapes and grades, was placed in predetermined locations in a mold, and production of the drilling tool was completed by various conventional techniques. In one such technique, a relatively hard metal carbide matrix body is formed which holds the diamond in place, the relatively hard tungsten carbide matrix material being used because of its erosion resistance as compared to other softer matrix combinations or other materials, such as steel. This carbide matrix, referred to as a crown, is attached to a steel blank by a metallurgical and mechanical bond formed during the formation of the matrix body. The matrix body may be formed by infiltration or diffusion bonding of the matrix powder. Natural diamond is sufficiently thermally stable to withstand the heating process in matrix formation. However, in most cases, the natural diamond is spherical in shape and about $\frac{2}{3}$ of the diamond is covered by the matrix in order to secure the diamond in place.

In this procedure as above described, the natural diamond could either be surface set in a predetermined orientation, or impregnated, i.e., diamond is distributed throughout the matrix as a grit or fine particle form.

With the early PCD elements, problems arose in the production of earth boring products of the matrix body type because PCD elements, especially PCD tables on carbide backing, tended to be thermally unstable at the temperatures and times used in furnacing the metal matrix bit crown, resulting in catastrophic failure of the PCD elements if the same procedures as were used with natural diamonds were used with backed PCD tables. It was believed that the catastrophic failure was due to thermal stress cracks from the expansion of residual metal or alloys used as the sintering aids or catalysts in the formation of the PCD element.

Brazing techniques were used to secure the cylindrical PCD table faced cutter into the matrix using PCD products of somewhat limited temperature stability. Brazing materials and procedures were used to assure that the temperatures during processing did not reach a level which would cause thermal degradation of the PCD facing. The result was that sometimes the PCD components separated from the matrix, thus adversely affecting the performance of the earth boring tool, unless special structures or procedures were used to assure adequate securing of the cutter structure to the matrix.

With the advent of thermally stable PCD elements, typically porous PCD material or other types of thermally stable non-porous PCD materials, it was believed that such elements could be surface set into the metal matrix much in the same fashion as was used with natural diamonds, thus simplifying the manufacturing of the tool, and providing better performance due to the fact that the PCD elements were believed to have the advantages of less tendency to polish and lacked the inherent weak cleavage planes of natural diamond.

Significantly, the current literature relating to temperature stable PCD elements suggests that the elements be surface set in the matrix with less than 0.5 mm exposure above the adjacent surface of the matrix body. Thus, like the use of natural diamond, more of the PCD was buried in the matrix than was exposed as an effective cutting surface, i.e., there was little available exposed surface to function as a cutting surface without the wearing away of a significant amount of adjacent matrix material.

The temperature stable PCD elements are said to be stable up to about 1,200 degrees C. and are available in a variety of shapes and sizes. For example, triangular PCD elements are available in sizes of 0.3 and one carat, and measure respectively 4 mm on a side and 2.6 mm thick, and 6 mm on a side and 3.7 mm thick. Cylindrical shapes are also available measuring 4 mm in diameter and 6 mm in length or 6 mm by 8 mm or 8 mm by 10 mm, for example; the latter sometimes being cut into half cylinders or quarter cylinders, or other shapes formed from the cylinders, and used in oil and gas drilling tools as disclosed for example in U.S. application Ser. Nos. 477,068, filed Mar. 21, 1983 and 652,180, filed Sept. 19, 1984 and both assigned to the same assignee. In addition, temperature stable products are available in cube and rectangular shapes having at least one side which measures 2.5 mm.

In the case of the cylindrical shaped products, cut in half or quarters and arranged radially with the surface of the bit or arranged generally parallel to the axis of rotation of the bit, one of the problems has been the use of such products in medium to hard formations. In the above identified applications, the cutters are only minimally supported to the rear of their cutting faces with the result that there is vibration of the diamond cutting element, due in part to the fact of the relatively large exposure above the surface of the face of the bit and the fact that the bit was used in medium to hard formations. While such bits operate satisfactorily in the softer formations, their use in the medium to hard formations has led to the loss of cutter due to the fracture of the PCD due to the nature of the formation and the relatively large exposure of the cutter above the face and the lack of adequate support to the rear of the cutter to reduce the effects of vibration during cutting of the formation.

It has also been noted in some of the prior designs that there has been a tendency to fracture the cutters during use due to the axial loads on the cutters. Thus, for example if the bit bounces during use, or is impacted against the formation when lowered into the borehole, fracture of the cutters may occur.

One of the other difficulties which has existed in the prior art use of defined geometrically shaped PCD cutting elements in the field of earth boring tools has been the tendency to follow the art of the use of natural diamonds in which the natural diamonds were surface set such that more of the diamond was below the matrix than was exposed above the matrix. In the prior art almost $\frac{2}{3}$ of the natural diamond was below the matrix with only $\frac{1}{3}$ exposure, with the result that if greater exposure was desired for more aggressive cutting action, larger sized and more expensive natural diamonds had to be used to obtain increased exposure.

The literature of one of the commercial suppliers of synthetic PCD elements suggests that for the 0.3 carat triangular PCD the exposure above the matrix should not exceed 0.5 mm. Other literature from that same supplier suggests that even with such small exposure, there should be a trailing support of matrix material behind the PCD which has only minimal exposure above the matrix. As a general rule, the prior art bits have been structured such that the exposure of the cutters beyond the face of the matrix is essentially uniform, except in the region of the transition of the shoulder to the gage.

The difficulties with surface set PCD elements with minimal exposure, whether backed or not are several and may be understood by considering the dynamics of the drilling operation. In the usual drilling operation, be it mining coring or oil or gas drilling, a fluid such as water, air or drilling mud is pumped through the center of the tool and flows radially outwardly across the tool face, around the outer surface (gage) and then back up the borehole. The drilling fluid clears the tool face of cuttings and cools the cutter elements. Where there is insufficient clearance between the formation being cut and the bit face, the cuttings may not be cleared from the face effectively and sometimes the desired flow across the bit face is other than the optimum for cooling. Other factors to be considered are the weight on the bit, normally the weight of the drill string and principally the weight of the drill collars, and the pressure effect on the fluid which tends to lift the bit off the bottom of the hole. It has been reported, for example, that the pressure beneath a diamond bit may be as much as 1000 psi greater than the pressure above the bit, resulting in hydraulic lift, and in some cases the hydraulic lift force exceeds 50% of the applied load while drilling. The hydraulic lift may reduce the bite which the cutters take of the formation with the result that penetration rates are decreased.

One surprising observation made in earth boring bits having surface set PCD elements or elements fully positioned below the adjacent body matrix, as has been the prior practice, is that even after exposure of the cutting face has been achieved by "run-in" to wear away the adjacent matrix and expose the cutting element, the rate of penetration (ROP) often decreases. Examination of the bit indicates unexpected polishing of the PCD elements. Usually ROP may be increased by adding weight on the bit but this is generally avoided if possible because it increases wear and stress on the drill rig. If the ROP is not acceptable, then it is necessary to trip out to replace the bit, an expensive operation since the economics of drilling in normal cases are expressed in cost per foot of penetration, a calculation which takes into account the bit cost plus the rig cost including trip time and drilling time divided by the footage drilled.

Bonding of diamond materials as cutters to the body matrix also presents other difficulties. If the PCD is supported on a WC support and the assembly is affixed to the body matrix by brazing, for example, the surface smoothness of the WC backing and that of the matrix material is a consideration. The rougher the surface, the more difficult it is to acheive a good braze bond. Thus, for example, U.S. Pat. No. 3,938,599 issued to Horn discloses a synthetic diamond material mounted on a sintered carbide blank which in turn is bonded to the matrix body. It is known from U.S. Pat. No. 4,200,159 that attempting to form a braze bond between a smooth carbide backing of a diamond faced cutter and the body matrix is difficult unless special steps and arrangements are used, factors confirmed by field experience.

To some extent, the above difficulties have been overcome by the use of the bit structures described in U.S. application Ser. Nos. 475,168, filed Mar. 14, 1983; 469,209, filed Feb. 24, 1983; and 473,020, filed Mar. 7, 1983, and all assigned to the same assignee.

Nonetheless, it is desirable to provide a drilling tool, especially an earth boring tool, having thermally stable PCD cutting elements in which the exposure of the cutting element above the body matrix and the exposed surface area is at the maximum while still proving sufficient anchoring of the cutting element such that it is effectively retained in the tool and the resulting structure is relatively stable with respect to impact loads.

It is also desirable to provide a drilling tool of the type described in which the cutting elements are arranged such that a large and exposed cutting face is provided which extends an appreciable distance beyond the adjacent matrix material which forms the bit body and wherein adequate provisions are made for support of the cutter to avoid the vibration and impact damage.

Another desirable objective is to provide a drill bit for use in earth boring in which essentially all of the PCD element is positioned beyond, that is, extending above the face of the bit and supported such that the bit is an aggressive cutting tool for soft to medium hard formations which are more abrasive than shale and mudstone.

It is also desirable to provide a drill bit of the type described with a significant exposure of PCD cutting elements located on pads formed between adjacent waterways such the cutting face of the cutting element is available for immediate cutting action without the necessity of run-in and is sufficiently supported to operate as an effective cutting element for a relatively long period of time.

Still another desirable object is to provide a drill bit, as described, in which cutting elements in the form of PCD cutters are mounted in the matrix during matrix formation and supported in the matrix of a bit such that those disposed along the nose of the bit are secured against breakage, but are sufficiently exposed to be effective cutters, while the PCD elements located along the flank and shoulder of the bit have maximum exposure for effective and aggressive cutting action.

Another object is to provide a matrix body drill bit, principally for use in oil and gas drilling, in which individual PCD cutting elements are secured in the body matrix is such a manner that some of the cutting elements in defined locations have a greater exposure than other cutting elements located in other defined locations whereby the cutting elements cooperate to provide a drill bit which is aggressive in its cutting action and wherein the cutting elements are firmly secured to the bit matrix face and uniquely supported to reduce their fracture due to vibration or impact damage during use.

Still a further object of the present invention is the provision of an improved hydraulic flow arrangement which is radial in nature such that the chips formed during cutting are effectively removed while effectively cooling the active cutting face of the cutter.

BRIEF SUMMARY OF THE INVENTION

In accordance with this invention an improved drilling tool especially adapted for oil and gas drilling and the like is provided in which there is maximum exposure of the cutting elements which are preferably temperature stable PCD elements, as described, and which are located and fixed in the body matrix during formation of the body matrix.

The earth boring bit may be a mining bit or any of the bits used in drilling for oil or gas, for example, and includes a matrix body member having a curved surface portion which includes a gage, shoulder, flank, nose, and apex, the curved surface forming the cutting surface of the bit. Above the shoulder is the usual gage. The matrix body member may be a relatively thin surface layer on a suitable backing support, as is know in the art, rather than the thicker body matrix which is well known and usually used in bits of the type to which the present invention relates.

The cutting surface of the bit includes a plurality of channels which form spaced pad elements between the adjacent channels. In a preferred form, the channels are arranged radially from essentially the center of the bit such that the flow of fluid is in a straight radial direction over the nose, across the flank and along the shoulder to the gage. This straight radial flow arrangement, in contrast to the feeder-collector hydraulic flow arrangement of the prior art, offers the advantage of effective cleaning and cooling of the bit face, and especially effective cooling of the cutting elements which have a substantial portion of their surface area exposed for direct cooling contact with the flowing fluid. To assure optimum flow of fluid across the face of the tool, a crowfoot or double crowfoot arrangement may be used, for example, in which the flow is into radially disposed channels. Since the surface area to be cooled and cleaned increases substantially as the flow exits from the source radially outwardly, there is a tendency for the fluid to become channeled with relatively high flow rates in only selected areas which are radially arranged with the principal fluid opening. Tests have indicated that initial fluid velocity and momentum are the dominant factors in effective hydraulics. In the case of relatively high velocity flow, it is difficult to cause the fluid to "turn corners" or flow in the desired direction to function as a cleaning and cooling fluid.

In accordance with one aspect of the present invention, that portion of the radial flow channels radially outwardly from the principal flow opening are constructed to direct the fluid to the face of the cutter by forcing a portion of the flow away from the trailing edge of the adjacent leading cutters. This is accomplished by a novel configuration of radially arranged flow channels which effectively causes the fluid flow to be directed in the proper direction and to the proper location in order to flow across the cutting face of the cutters which are mounted on the pads between adjacent channels.

By way of explanation, in cross-pad flow arrangements the fluid courses are of an essentially constant dimension from the fluid outlet source opening to the gage, with larger spaces between the adjacent pads. This type of arrangement is acceptable where harder, more abrasive formations are drilled because the chips tend to be smaller as compared to other softer formations. Not every fluid course has its own originating source of fluid with the result that there is flow of fluid across the pads.

In radial flow systems in accordance with one aspect of the present invention, every fluid course has its own source of fluid from the fluid exit ports and the fluid courses or channels are as described. This type of radial flow pattern and structure, in accordance with this invention provides more effective cooling, especially in softer formations in which cleaning is more important because the cuttings are more plastic when compared to harder formations. Another advantage of radial flow hydraulics is that junk slots need not be present and thus the tendency to upset bit balance by the junk slots is avoided.

Located in each pad are a plurality of spaced synthetic PCD elements, as described, which are mounted in the matrix body during formation of the body. The cutting elements are of a predetermined geometrical shape and are temperature stable to at least about 1,200 degrees C. Thus, while the PCD elements are temperature stable, as previously described, there is the generation of relatively high local heats during a drilling operation with possible thermal degradation of the cutting elements, especially in the harder formations. By this invention, the extensive exposure of the surfaces of the cutting elements permits the drilling fluid to contact the same over a substantial portion of the exposed surface area in order to effect more efficient cooling of the same during use. This is of practical importance since the heat conductivity through the PCD is three to five times greater than the heat conductivity of the matrix body material. Accordingly, wile some of the prior art designs have adequate flow of fluid across the matrix body components of the bit, the comparatively low heat conductivity of the matrix body material does not offer a good heat sink for dissipation of heat in comparison to direct contact with the PCD itself.

The cutting elements, of a geometry to be described, include a front face which has a predetermined surface area and a longitudinal axis which is arranged generally parallel to the axis of rotation of the bit. The cutting elements include portions adjacent to the front face and generally to the side thereof, as well a a rear portion. A minor portion of the cutting elements is received in the matrix of the pad, with a substantial portion of the cutting element exposed above the surface of the pad. Thus, the cutting elements are so positioned in the matrix material of the pad such that the front face extends above the pad to form the cutting face while the adjacent portions of the cutting element are disposed such that one is adjacent to the pad and the other is spaced from the pad, with the adjacent cutters along the nose and flank being spaced from each other such that there is some minor flow circumferentially between adjacent cutters of each pad. By positioning the cutting elements as described, those located in the flank and shoulder have an exposed cutting face whose surface area is greater than a majority of the predetermined surface area of the front face thereof. A large front cutting face is thereby provided for cutting and which may be effectively cooled. The side portions of the cutters are also exposed, the side portion spaced from the pad being essentially fully exposed and being of a greater surface area than the portion adjacent to the pad which is also partly exposed, with fluid flowing between adjacent cutters as mentioned. The cutters may be arranged with a five to twenty degree back rake and a tilt of between about zero to five degrees from the vertical axis, depending upon the geometry of the cutter and the location on the bit. In some cases, especially for drilling in hard rock formations, the tilt amgle may be ninety degrees to the bit surface.

Regardless of the location of the cutting element, more than 0.5 mm of the cutting element is exposed above the matrix of the pad and the rear portion of the cutting element is supported by matrix material.

In a preferred form, the drill bit of this invention includes cutting elements, as described, whose side exposure is somewhat unique. For example, all of the cutters, regardless of position on the cutting face have at least the same minimal side exposure which is geater than 0.5 mm. In some cases, the side exposure of that side of the cutter away from the pad is somewhat greater than the other side of the same cutter, depending upon location of the cutters in the bit face. The side exposure of those cutters at the nose is the same as the side exposure of one side of the cutters located along the flank and shoulder, but in either case, the exposure is more than 0.5 mm above the surface of the associated pad. Even with a somewhat lesser exposure, there is adequate direct cooling because of the radial nature of the flow, i.e., the amount of fluid flow over the cutters is greater per cutter along the nose than along the flank and shoulder. However, the amount of total exposed surface area per cutter, including the side surfaces, is greater at the flank and shoulder than at the nose, as will be explained in detail.

Overall, the bit is a stepped bit in configuration with blades or pads and the cutters arranged on the bit face in a redundancy pattern such that the bottom of the hole is traversed by one and preferably at least four cutters. In such a case the cutting action of the cutter elements is that of a chisel, with a shearing action in cutting, with some kerfing action, with the result that the torque is somewhat lower than the prior art bits in certain formations. The bit of the present invention is intended for use in formations of shale with hard stringers and sandstone or limestone with shale sections.

One further aspect of this invention is the nature of the cutting action in which that the portion of the formation between a preceeding and trailing cutter is relieved of the confining stress and as the cutters pass, the confining stress is partially released and the formation tends to fracture even though not directly contacted by a cutting surface.

In a preferred form, the cutting face of the cutter element is located close to the junction of the pad and the associated channel. This arrangement and the improved hydraulics operates to provide a significantly improved bit structure, although the radial flow hydraulics may be used with other cutter configurations.

Due to the relatively large surface area of the cutting face, the bit of the present invention tends to perform well in soft formations as compared to some of the bits previously discussed. More specifically, shale tends to ball up less when cut by the bit of this invention and the present bit cuts well in soft to hard sandstone formations as well as some harder rock.

Another aspect of this invention is the provision of an improved mounting for each of the cutters which reduces the potential for cutter damage due to impact loads. From a view of dynamics of cutting, it is desired to have a sharp exposed and pointed cutting edge. However, such an arrangement is prone to impact damage due to high unit impact forces. To reduce the tendency for damage due to impact loads, the cutter-matrix support is constructed to provide a flat upper surface, i.e., the surface which faces the formation, whose length is less than the length of the supporting matrix to the rear of the the rear surface of the cutter. The flat or planar top surface of the cutter-matrix assembly may be achieved through the use of a cutter having a broad upper exposed surface, such as a split cylinder, or the use of a triangular element set such that there is a short trailing support which forms a short pad to the rear of the cutting face. In this way, a large bearing surface is avoided since that tends to inhibit the cutter from biting into the formation, but sufficient upper surface is provided to distribute the impact shock loads over a greater surface area, while providing sufficient support to the rear of the cutter to prevent vibration and to provide back support during cutting.

The present invention possesses many other advantages and has other objects which may be made more clearly apparent from a consideration of several forms in which it may be embodied. Such forms are illustrated in the drawings accompanying and forming part of the present specification. The forms described in detail are for the purpose of illustrating the general principles of the present invention; but it is to be understood that such detailed description is not to be taken in a limiting sense.

BRIEF DESCRIPTION OF THE DRAWINGS

Referring to the drawings:

FIG. 1 is a view in perspective of one form of mounting a PCD cutting element in accordance with the present invention;

FIG. 2 is a view in perspective of the mounting shown in FIG. 1 as seen from the front cutting face of the PCD;

FIG. 3 is a view of the type of teeth shown in FIGS. 1 and 2 where one tooth is shown in section taken along line 3—3 of FIG. 1 and the other tooth is shown in side elevation.

FIG. 4 is a view partly in section and partly in elevation taken along the line 4—4 of FIG. 3;

FIG. 5 is a view elevation taken along the line 5—5 of FIG. 3;

FIG. 13*a* is a fragmentary somewhat enlarged view in perspective of a portion of the bit of FIG. 12 and illustrating the mounting of the PCD elements in accordance with this invention;

FIG. 13*b* is a view similar to that of FIG. 13*a*, illustrating a modified form of mounting for the PCD elements;

FIG. 20 is a fragmentary plan view of an improved form of waterways and improved hydraulics in accordance with the present invention.

DETAILED DESCRIPTION OF THE PREFERRED EMBODIMENTS

Figure 6:
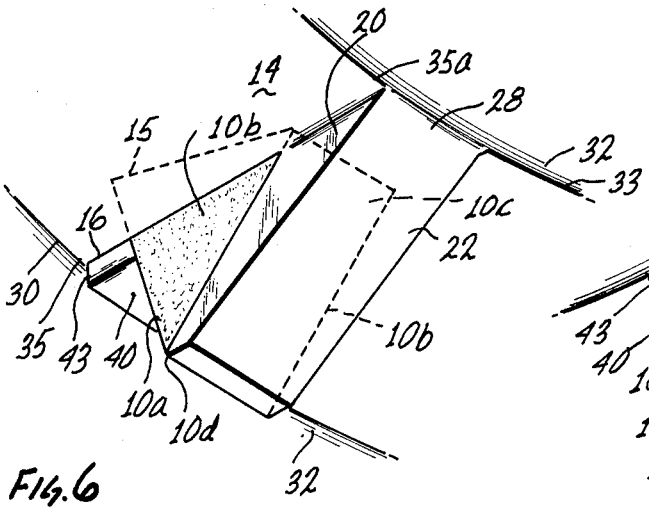
FIG. 6 is a view in perspective of another form of mounting for the PCD in accordance with the present invention.

The drill bit of this invention tends to perform better than the prior art drilling bits in the formations mentioned, especially in formations of mixed shale and sandstone, limestone and which include portions of hard and abrasive stringers, major sections of sandstone, or mixed shale and sandstone. The drill bit of this invention is not as effective in soft, sticky formations. Thus, referring to the drawings which illustrate preferred forms of the present invention, FIGS. 1-5 illustrate one form of mounting a PCD cutting element 10 (and 11) in a matrix body support generally designated 12. The matrix support is part of the body matrix 14, both the body and support being formed by the procedures already mentioned, infiltration or diffusion bonding, or the like, and the matrix is preferably of a tungsten carbide type for erosion and abrasion resistance. The PCD is mounted directly in the matrix, during matrix formation, and is preferably a temperature stable PCD, as already described.

In the form illustrated in FIG. 1, the PCD element 10 is triangular in shape and may be of the dimensions previously described and of the size already noted. Other geometrical shapes may be used, as will be described. As shown, a minor portion 15, shown in dotted form, of the PCD is below the surface 16 of the body matrix, while a majority of the cutting element extends above the surface. As shown, the PCD 10 includes a front face 10*a*, side portions adjacent to the front face in the form of side faces 10*b* and a rear portion 10*c*, with 10*d* indicating the top of the PCD. In this form and in the other forms to be described, the front face 10*a* of the cutting element has a predetermined surface area, calculable from the illustrative dimensions already given, and a longitudinal axis 17. It is apparent from the drawings, which are not to exact scale, that a major portion of the surface area of the front face 10*a*, which forms the cutting face, is above the body matrix surface 16, i.e., the exposure of the PCD above the surrounding body matrix is far greater than 0.5 mm, as will be explained in detail later.

To the rear of the rear portion 10*c* of the cutting element 10 is a matrix backing 20 which slopes from the top 21 of a top pad element to the rear, joining with the body matrix 14. The matrix backing 20 operates to provide a backing support to support the cutter with respect to front face loading during the cutting action. Since the cutters have such a large exposed cutting face, the loads from the front to the rear of the cutting elements are significant. Between the top 10*d* of the cutting element 10 and the sloping rear surface 22 of the backing is a top pad element 25, again of matrix material and which serves as a short pad to absorb the axial shock and bouncing loads rather than allowing these loads to be absorbed directly on the top surface 10*d* of the PCD element 10. This pad, though relatively small as measured from the front face of the cutting element, extends across the full width of the cutting element and is sufficient to impart significant axial load resistance to the cutter 10 as compared to the same structure without the pad 25. To assist retention of the PCD 10 in the matrix support, the body matrix 14 includes a front portion 27, at essentially the same level as surface 16, to lock in place the forward corner 27*a* of front face 10*a* of the cutter 10. Preferably not more than about one-third of the front face 10*a* of the PCD is positioned below the surface of the matrix material.

Referring now to FIGS. 1–5, the PCD cutters 10 and 11, and many of the other PCD cutters which make up the drill bit, are mounted on body pads 30 which are located between adjacent spaced channels 32 through which fluid flows for the purposes of cooloing the cutting face 10*a* and to remove cuttings. The channel includes a side wall 33 which intersects the body pad at 35, the PCD cutting elements being set adjacent to the intersection, but spaced rearwardly therefrom by a distance which represents the circumferential dimension of the front portion 27, i.e., the dimension from the junction 35 to the front face 10*a* of the cutter at the region where the cutter intersects the body pad 30. This is apparent from cutter 11, shown in perspective, which is offset with respect to cutter 10, the latter being shown in section. In a preferred form, the rear surface or wall 2 of the matrix support 12 is sloped as shown and intersects the side wall of the channel.

To improve the cutting efficiency of the cutters 10–11 and the other cutters, they are mounted in the support 12 with a small back rake, less than about 25 degrees and in the range of 5 degrees to 20 degrees with a preferred back rake being 15 degrees, as seen in FIG. 3.

As mentioned, a substantial portion of the front face 10*a* of each cutter is exposed above the surface 16 of the body pad in which it is received, as seen in FIG. 4, and there is a significant portion of the front face which extends above that surface. Further, a minor portion 15 of the cutter is located in the body pad. In the case of triangular cutting elements, the rectangular face is the cutting face and the setting is referred to as a tangential setting. It has been discovered that a tangential setting and the relatively large exposure of the front face enables good performance in the softer formations. Thus, as seen in FIG. 4, assuming a one-third carat PCD cutter having rectangular face of 4 mm by 2.6 mm, the front exposed face 10*a* of the cutter extends far greater than 0.5 mm above the surface 16 and may extend as much as between about 2.0 mm and 2.5 mm above the level of the front portion 27, i.e more than 50% of the front face is exposed. The exposed surface area is between 5.27 sq. mm and 6.6 sq. mm. In the case of a one carat PCD elements, the exposure above the level of the front portion 27 may be between 3.3 mm to 4.5 mm with an exposed front face surface area of between 12.21 sq. mm to 16.65 sq. mm. Again, more than 50% of the front face is exposed. These relatively large exposed front faces, in addition to providing a large surface area available for cutting, also provides a large surface area which may be cooled by the fluid. It is also clear from FIGS. 4 and 5 that the side portions 10*b* of the PCD cutters are fully exposed. The advantage of full side exposure and large surface area full face exposure is that there is better overall cooling of the PCD cutters which tend to develop localized high heats at the cutting regions of the PCD cutting elements. In general, it is far better to cool the cutters directly than to cool the cutter by cooling the matrix within which they are supported, expecially since the matrix material is not as good a conductor of heat as compared to the PCD. The heat conductivity of the PCD may be as much as 3 to 5 times that of the matrix, depending upon matrix composition. The drill bits of the present invention are more aggressive drilling bits, in that they cut more rock, faster and with less energy than the prior drill bits already discussed. It is also true that the drill bits according to the present invention are capable of withstanding higher point loading per cutter than may have been the case with prior art devices. Higher point loading, in effect, means better drilling performance, while effective cooling tends to extend cutter life.

FIG. 4 also shows that the top front surface 34 of the cutter is free of matrix material, in the preferred form, so that there is no "run-in" required for the effective cutting surface to engage the formation at the initial start of the use of the drill bit. In effect, the bit may be lowered into the borehole and may start cutting as soon as the cutters contact the opposed surface of the formation without the necessity to abrade away matrix material to expose the cutting surface. This is apparent from FIG. 4, which is a view as one would see if it were possible to look directly at the front face of a cutter during drilling.

In the view seen in FIG. 5, it is apparent that the support body for the cutter preferably extends from the junction 35 of one body pad and channel wall 33 to the junction 35*a* of an adjacent body pad and channel wall of the adjacent channel. It is to be understood that the PCD cutting elements are mounted on a surface of the bit which may be curved, as will be described.

Figure 7:
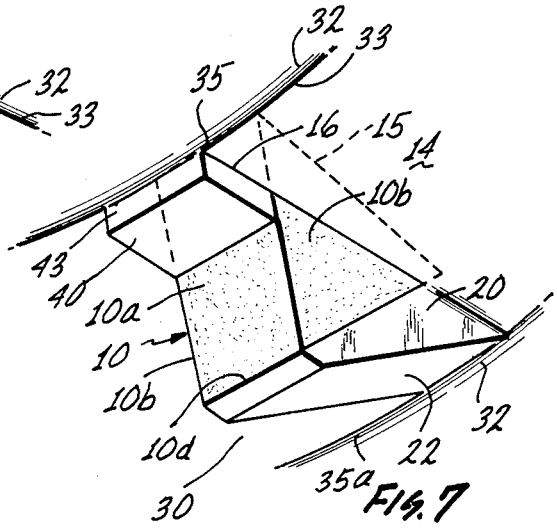
FIG. 7 is a view in perspective of the mounting arrangement as shown in FIG. 6 as viewed from the front of the cutting face.

In the form of mounting arrangement for the PCD cutting element illustrated in FIGS. 6 and 7, in which the same reference numerals have been applied to the same elements previously illustrated, a prepad 40 which assists in retention of the PCD includes a flat front face 43 located along the intersection 35 of the channel wall 33 and surface 16 and which extends along the full width of the front face 10*a* of the PCD. The prepad 40 may be used where more abrasive formations are contemplated to assure that the front support is not abraded away during drilling.

Figure 8:
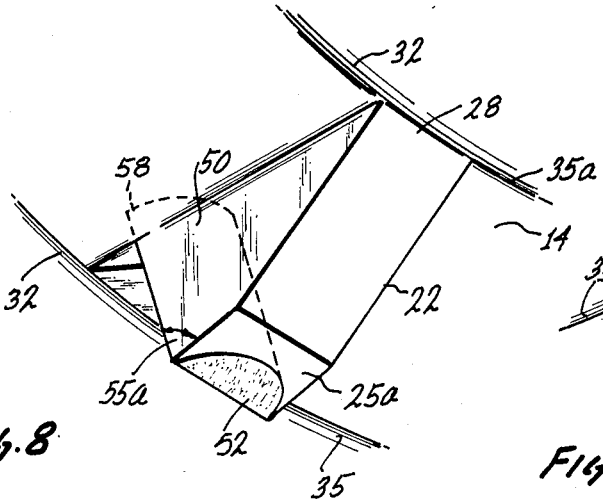
FIG. 8 is a view in perspective of a mounting arrangement of a half-cylinder PCD cutting element in accordance with the present invention.
Figure 9:
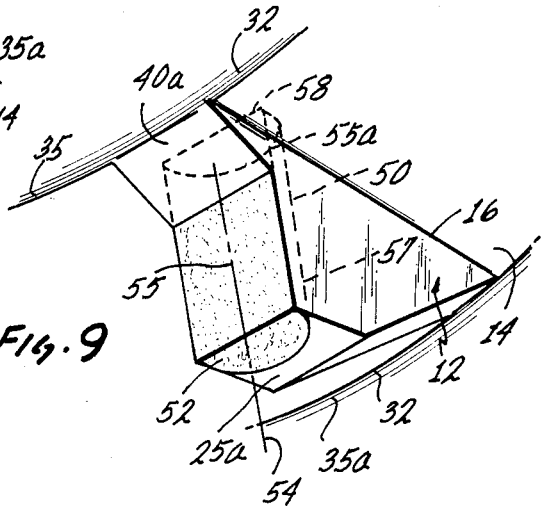
FIG. 9 is a view in perspective of the mounting arrangement as shown in FIG. 8 as viewed from the front of the cutting face.

FIGS. 8 and 9 illustrate the use of a thermally stable PCD element of the type previously described in the form of a half cylinder 50. In this particular instance, the cutting element includes a rather broad upper surface 52 and is thus better able to withstand high axial loads since the point loads are distributed over a larger surface area as compared to a triangular cutting element. Nonetheless, it is prefered to use a top surface pad 25*a*, as shown, and which extends the full width of the cutting face. The advantage of this type of cutter is that there is a greater amount of depth of PCD at the top of the cutting element. Again the PCD cutting element includes a longitudinal axis 54 and a relatively large surface area front face 55. The rear portion 57 is cylindrical and the exposed side face 55*a* is of a relatively small dimension due to the curvature.

Again there is a prepad 40*a* which may also be of the type shown in FIGS. 6 and 7. The matrix support 12 is sloped as described, while the cutter 50 and the matrix support are positioned with respect to the channels 32 as already described. As noted, the half cylinder cutters may be of various sizes. In each case however, the amount of front face exposure above the matrix adjacent to the cutter is more than the portion which is received in the matrix. As shown only a minor portion 58 is received within the matrix body pad 14 and below its surface 16, such that the cutter extends more than 0.5 mm above the surface of the body pad.

The half cylinders may be formed by cutting cylindrical elements in half along the long axis thereof. A 4 mm by 6 mm cylinder provides two PCD elements having a flat front cutting face which is 4 mm by 6 mm, and a 6 mm by 8 mm provides two half cylinders of a flat front cutting face dimension of 6 mm by 8 mm. Other sizes may be used but in each case the half cylinder is mounted such that more than about 50% is exposed above the body pad surface. In some instances, one end of the cylinder is in the form of a cone. In that instance the point of the cone may be imbeded in the matrix or may be the upper surface. It is preferred to use the flat end face as the upper exposed cutting face. With this geometry of cutter it has been noted that the tilt may be eliminated, if desired. It is preferred that there be a back rake in the amount indicated.

Figure 10:
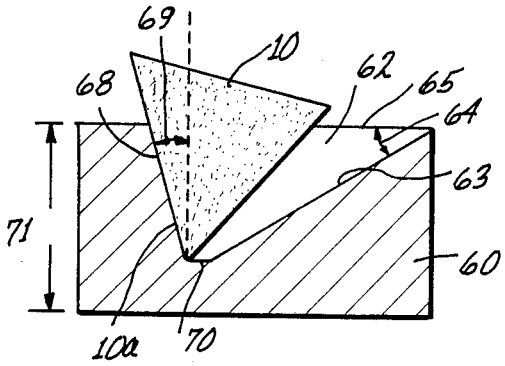
FIG. 10 is a diagrammatic view of a portion of the mold used in fabricating bits in accordance with this invention and illustrating the position of a triangular PCD element.
Figure 11:
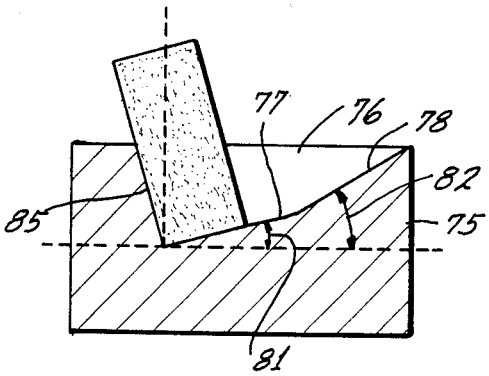
FIG. 11 is a view similar to that of FIG. 10 but illustrating the position of a half-cylinder PCD element.

To facilitate understanding of the manner in which the PCD is mounted, reference is made to FIG. 10 which illustrates diagrammatically a portion 60 of the mold used to form the bit. For purposes of explanation, reference will be made to a one carat PCD of the dimensions previously described. The mold includes a cavity 62 having a sloped wall 63 which corresponds to the sloped wall 22 of the back support. The angle of the wall 63, as indicated at 64 is 31 degrees, although angles between 15 and 40 degrees may be used. This angle is measured between wall 63 and surface 65, the latter corresponding in position to the surface height of surface 16. Wall 68 is angled in an amount of 15 degrees, as indicated at 69, for example, and represents the back rake angle of the front face 10*a* of the cutter. Angles 64 and 69 may be other than that as shown for purposes of illustration. The mold also includes a lower flat surface 70 which forms the top surface pad 25. From FIG. 10, it can be seen that a substantial portion of the PCD is above the surface 16, the portion above that surface being represented by the portion of the PCD 10 which is below the surface 65 of the mold. In the form shown, the dimension at 71 is about 3.81 mm and thus the exposure of the front face is slightly greater than that dimension. In processing, the mold is filled with matrix powder such that the cavity 62 is filled as well as that portion above surface 65, and processed, with the result that the finished product is as illustrated in FIGS. 1 and 2.

The mold portion 75 illustrated in FIG. 1 is used to produce the mounting of the PCD as illustrated in FIGS. 8 and 9. Again, the mold includes a cavity 76 having bottom wall portions 77 and 78. Wall portion 77 forms the top surface pad 25*a* and is angled at 15 degrees as indicated at 81 while wall portion 78 forms the rear surface 22 and is angled at 30 degrees, as indicated at 82. The dimension of the wall portion 77 is about 4.42 mm, assuming a half-cylinder whose radius is 3 mm. The axial length of the half-cylinder is 6 mm thereby providing a front face exposure of slightly greater than 3.125 mm. Surface 85 of the mold is inclined at about 15 degrees to provide a back rake, the front flat face of the half-cylinder being positioned in facing relation with surface 85. After processing, the resulting mounting is as shown in FIGS. 8 and 9.

Figure 12:
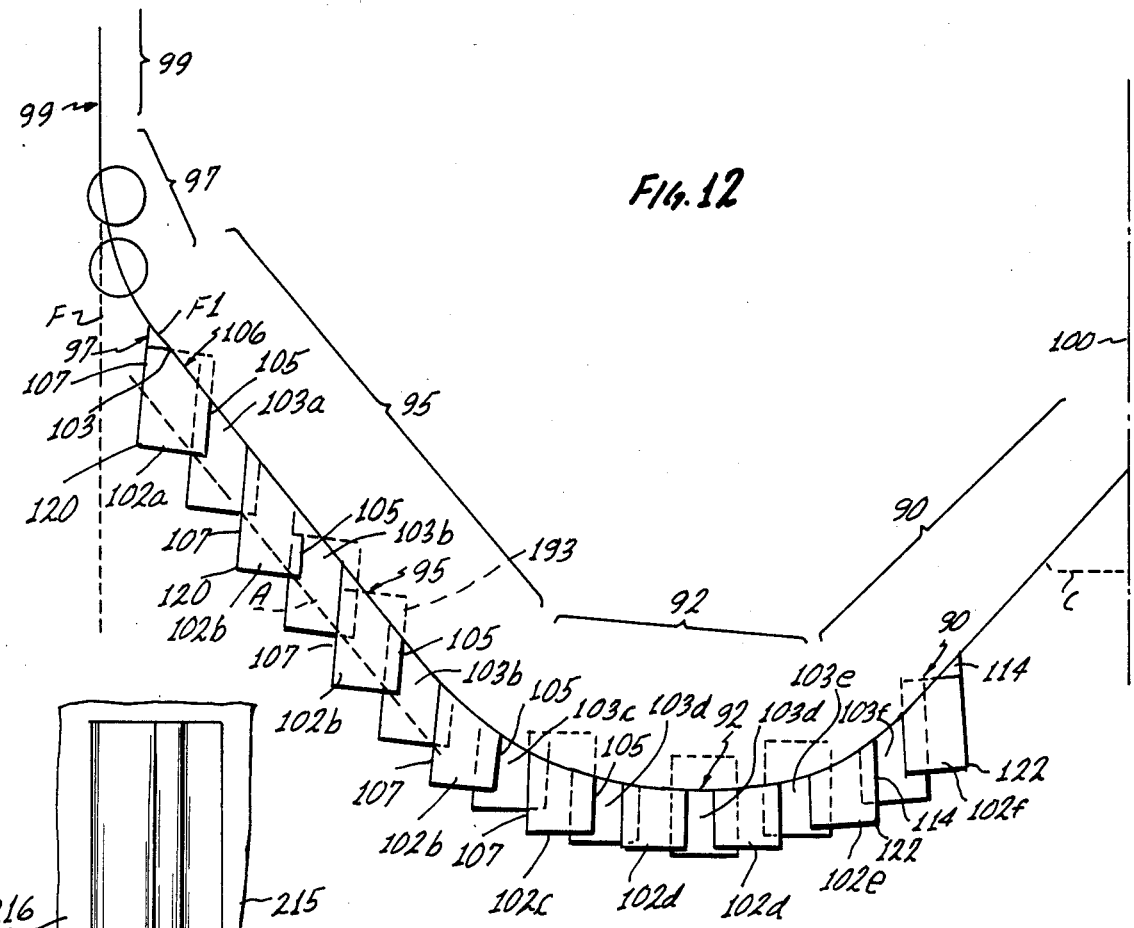
FIG. 12 is a diagrammatic view of a drill bit in accordance with the present invention illustrating the general orientation of the cutting elements.
Figure 16:
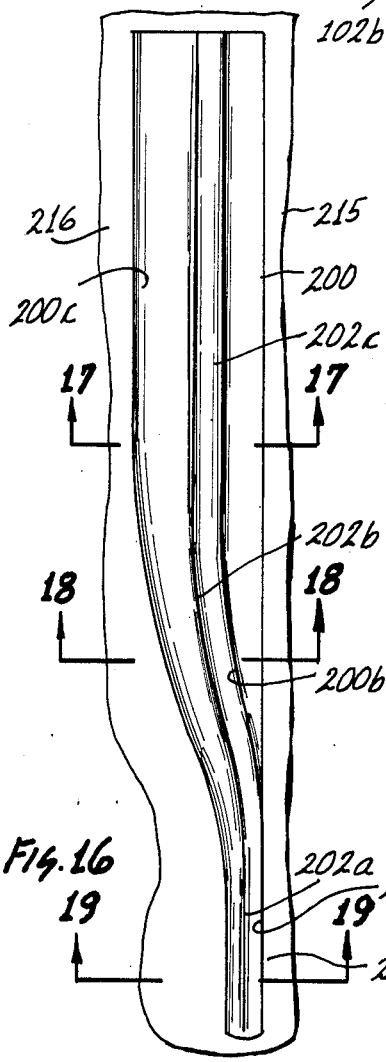
FIG. 16 is a fragmentary plan view of one of the improved radial waterways in accordance with the present invention.

FIG. 12 illustrates in somewhat diagrammatic form the position of the cutting elements and the relative tilt and general orientation of the cutters with respect to the center axis of the bit. Thus a plurality of cutters are shown located in the cone generally designated 90, the nose generally designated 92, the flank generally designated 95 and the shoulder generally designated 97. The gage 99 is vertically above the shoulder 97. As will be seen from this illustration, the cutters are arranged such that their longitudinal axes are in general alignment with the axis of rotation 100 of the bit. Some of the cutters are provided with a tilt, for example cutters 102*a* near the shoulder 97 and cutters 102*b* from the flank 95 and along the flank all have a tilt of about 5 degrees. The cutters 102*c* in the area between the flank and the nose have a tilt of about 3 degrees, while those 102*d* in the nose have no tilt. In the transition from the nose to the cone, the cutters 102*e* have a tilt of negative 3 degrees while those 102*f* in the cone have a tilt of 5 negative degrees. The different tilts of from 5 degrees to a negative 5 degrees of the cutters located in different portions of the bit are used to provide a smooth transition across the bit face and to reduce high side loads.

It is also apparent from this Figure that side exposure of the cutters is at least that of the cutters 102*d*, with side exposure of one side of the cutters increasing as will be described.

As will be described further below, the cutters are set in a redundant pattern so that at least two or more cutters traverse the formation. In the view in FIG. 12, the second set of cutters 103*a*, 103*b*, 103*c*, 103*d*, 103*e* and 103*f* have a tilt as described for the series 102 cutters. It is to be noted, however, that the side exposure of some of the cutters varies, depending upon the location of the cutter. Thus, in each case the cutters 102*a*, 102*b* and 102*c* each include one side face 105 whose exposure, measured axially from the matrix surface 106, is less than that of the opposite side face 107, i.e., the radially outward face has a greater exposure than the face of the corresponding cutter adjacent to the matrix body 106. The same is true of the corresponding 103 series cutters. The side faces of cutters 102*d* and those of the 103*d* cutters have essentially the same side face exposure on each cutter. In the case of the cutters 102*e* and 102*f* and the corresponding 103 cutters, the situation is the reverse, in that the radially inward face 114 has a greater exposure than the radially outward face.

As can be seen from FIG. 12, the general appearance of the bit is that of a stepped bit, which is of importance with respect to the nature of the cutting action. For the cutters along the shoulder and flank, the radially outward region 120 is the primary cutting region. For those cutters in the cone and the transition from the nose to the cone, the primary cutting region is the radially inward region 122. The principal cutting action, according to theory, is that of a kerfing-like cutting action, as may be understood with respect to the following illustration. The portion of the formation between the side face 107 of cutter 102*b* and vertically above the cutting region 120 and that portion of the formation along the top exposed surface of the cutter 103*a* is effectively unsupported. Thus as the pairs of cutters pass, the formation between two cutting regions is relaxed. As the trailing cutters contact the relaxed formation, it is easier for the trailing cutters to cut the relaxed formation. This type of cutting action tends to cause the unsupported portion of the formation to crumble or weaken such that during the pass of subsequent cutters, the formation is more easily cut. This cutting theory is in accord with actual field experience which has demonstrated that the more irregular and sharper the cutting profile, the faster the cutting action. Moreover, assuming uniform wear on the cutters, they should be operative until the cutters are worn to the line "A" of FIG. 12.

In the form illustrated in FIG. 12, the flank angle, as measured between line F and F1 is between 35 and 50 degrees, while the cone angle is between 110 and 130 degrees, as indicated at C which shows half of the cone angle.

As seen in FIG. 12, the flank angle and tilt and relative position on the cutter face have an effect on the amount of change in the side exposure of the PCD cutters from the nose to the general area of the gage.

As seen in FIG. 13, (wherein the same reference numerals have been used where applicable) and with respect to the cutters in the flank area and the region from the nose to the flank, a greater amount of the side face 10*b* is exposed than is the case with the side face 10*d* and a minor portion of the front fact 10*a* is below the matrix body. As one proceeds towards the gage, essentially the entire side face may be exposed, see cutter 106 of FIG. 12, for example. In the case of the cutters located at the nose, the side exposure is essentially the same on each side and is in the amount previously specified. Accordingly, there is at least one side of each cutter that has the same side face exposure while the remaining side faces of the remaining cutters have either the same exposure or a greater exposure, as is seen in FIG. 12.

FIG. 13 also illustrates the fact that the prepad 40*c* and the back support surface 22 may include portions 40*d* and 22*a* which are at the same level as the body pad 30 while portions 40*e* and 22*b* are positioned above the body pad portion 30*a*. In the view of FIG. 13, the width of the tooth is essentially equal to the width of the pad. The form illustrated in FIG. 13*a* is similar to that of FIG. 13, except that the width of the pad 30 is wider than the width of the tooth, the latter including a curved rear surface 22*d*.

Figure 14:
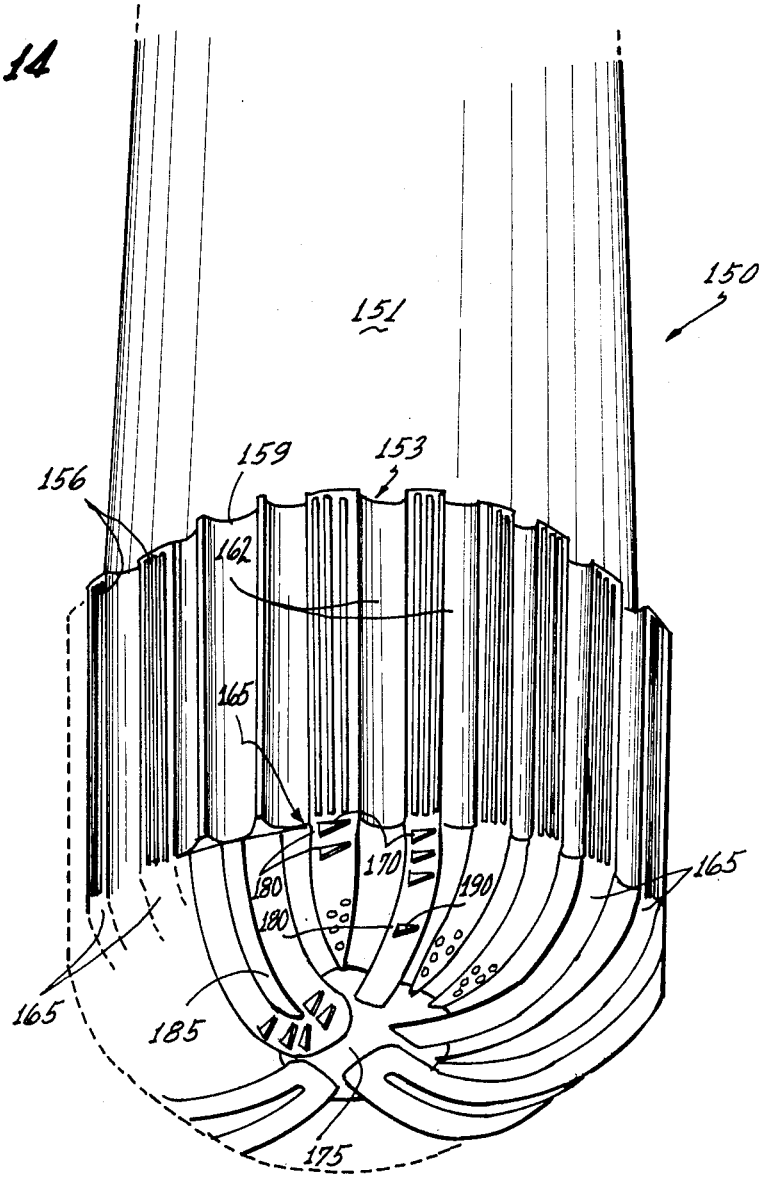
FIG. 14 is a view in perspective of a drill bit in accordance with the present invention illustrating the radial arrangement of the waterways and the location of the cutters.

In FIG. 14, it can be seen that the drill bit 150 includes the usual shank 151 with an appropriate connection for mounting on the drill string or downhole motor or turbine. The body 153 is of matrix body material as described, and includes the usual gage section 156 in which natural or synthetic diamonds may be used as the gage stones. The bit may include a plurality of junk slots, one 159 being shown. The curved face of the bit includes a plurality of spaced radially disposed channels 162, which approximate the curved contour of the bit face. The spaced channels form a plurality of spaced pad elements 165 between and separated by the adjacent channels, the cutting elements 170 being mounted on the pad elements 165 as already described. For ease of illustration, not all of the cutting elements are shown, it being understood that each pad includes cutting elements whose density of distribution may vary, as needed. The cone region 172 of the bit is provided with one or more openings 175 for flow of fluid to the channels 162 for cleaning the cuttings and for cooling the cutters, as described.

From FIG. 14, it is apparent that the flow of fluid is radial, i.e., from the cone, radially outwardly along the waterways and radially along the bit face. It is also noted that the cutting face 180 of the cutters is preferably closer to the channel forward of the cutter with respect to the direction of bit rotation rather than being centered in the channel, in order to remove the cuttings and to effect more efficient cutting. While the general flow pattern is radial, there is also some minor flow of fluid between adjacent cutters in the space between adjacent cutters. In this form, all of the channels 162 except 185 communicate directly with the opening 175 through which fluid flows.

From the views illustrated in FIGS. 12–14, it is easier to understand the nature of the cutting action and the orientation of each of the cutters. Thus, it can be seen from FIG. 14 that the exposure of at least one of the side surfaces of the cutting element is not the same in the shoulder and flank regions as it is in the cone area. It is also apparent that not all of the PCD cutter is below the surface of the pad, although the amount of cutter received within the pad may vary depending upon the curvature of the bit face. As a general rule, a portion of the PCD cutter opposite the face 190 is received in the pad matrix while side 190 is completely out of the body pad matrix and is supported by the cutter pad which is between the body pad and the PCD cutter. This can also be seen in FIG. 12 in which the dotted line 193 represents the PCD cutter. In general, and other than those cutters in the nose, it is the radially outward surface or side portion which is fully exposed and out of the body pad, except in the case of the cutters in the cone section in which the radially inward side tends to be out of the matrix due to the reverse in the bit face curvature.

One aspect of the present invention is the improvement in the hydraulic flow of fluid across the bit face, which as noted, is preferably radial. Due to the nature of the geometry in radial flow, it is necessary for the fluid emanating from the opening 175 to change direction somewhat in order to achieve a pure radial flow pattern. Since the flow rates used in drill bits is quite high, in terms of surface feet per minute, there are problems in directing radial flow in order to change the direction of this high velocity flow if that is necessary in order to achieve optimum flow conditions for cleaning and cooling. Thus, for example, there have been instances in which the majority of the flow out of the opening 175 tends to be concentrated in an arc with regions of reduced flow on each side of the arc. It is believed that this condition exists due to the difficulty of effecting a fanning out of the flow, having in mind that the channel tends to get wider and deeper from the center of the bit radially outwardly and along the curved surface towards the gage.

In accordance with this invention, as seen in FIGS. 15–19, an improved system of waterways 200 is provided in which a portion of the waterway includes a partially raised rib 202 in at least a portion of the waterway. As seen in FIGS. 16–19, the waterway 200 is generally narrowest at 205 which is the region closest to the cone area 215 (FIG. 15) of the bit. In that region, the rib 202*a* is of its smallest transverse and vertical dimension with respect to the waterway 200*a*. As one proceeds along the length of the waterway it widens and becomes deeper, as indicated at 200*b*, while the rib becomes progressively wider and of greater vertical height as compared to portion 202*a* of the rib. Still further along the waterway, the latter is wider and deeper still as indicated at 200*c* and the rib is likewise wider and deeper as indicated at 202*c*. In effect the vertical dimension of the rib increases from a minimum adjacent the center region of the bit to a maximum at a region spaced from the center of the bit.

Figure 17:
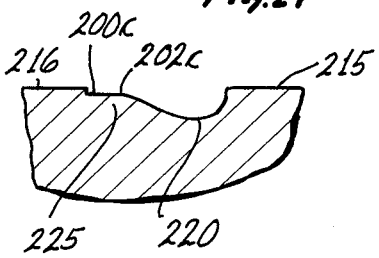
FIG. 17 is a sectional view taken along the line 17—17 of FIG. 16.
Figure 18:
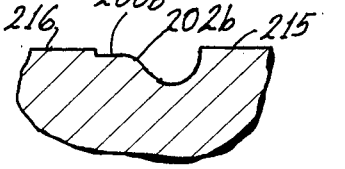
FIG. 18 is a sectional view taken along the line 18—18 of FIG. 16.
Figure 19:
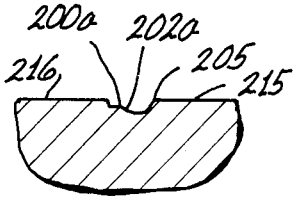
FIG. 19 is a sectional view taken along the line 19—19 of FIG. 16.
Figure 15:
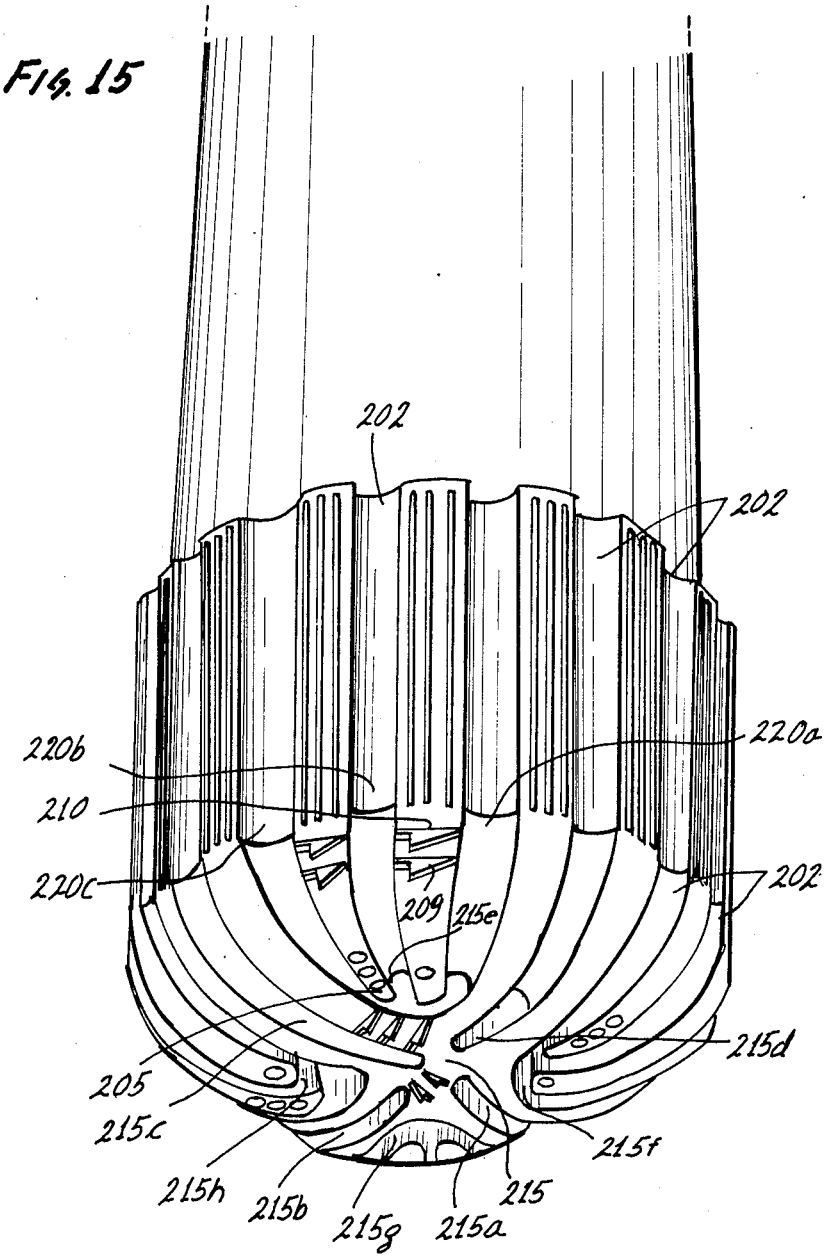
FIG. 15 is a view in perspective of a drill bit in accordance with the present invention illustrating the general arrangement of the bit structure and the improved radial waterways in accordance with the present invention.

As seen in FIG. 15, the rib 202 is located in the channel such that it is closer to the rear 209 of the cutter to its left, as seen in FIG. 15, than it is to the face 210 of the cutter to its right, again as seen in this drawing. In effect the rib forms a contoured damn forcing the flow against the front face of the cutter which is positioned on surface 215 and away from the rear face of the cutter which is located on surface 216, as seen in FIG. 17. Due to the geometry of bits in general and the nature of radial flow configurations of waterways, the quantum of flow tends to decrease from the center of the bit radially outwardly. The result may be that there are cutting faces which are not adequately cooled or wherein cuttings are not effectively removed. Thus the waterways, in accordance with one aspect of this invention, are configured to direct the flow of fluid into the relatively deep portion 220 of the channel by using a smooth configured rib 202 which has a high region 225 spaced from the front face of the trailing cutter. Radial flow is now achieved in a form in which the major flow is adjacent to the cutting face in those instances in which it is difficult to channel the flow towards the cutter faces due to bit or cutter or channel geometry. The use of channels with the ribs, as discussed is a highly effective and relatively simple structure to achieve the desired radial flow in this particular configuration of bit as well as bits of other configurations in which good radial flow is desired as opposed to feeder-collector flow systems.

Another aspect of the improved hydraulics of this invention is the fact that each channel 202 communicates directly with a fluid opening in the bit body. To accomplish this, a double crowfoot 215 is used in which there are a plurality of inner openings 215*a*, 215*b*, 215*c* and 215*d*, each of which communicates with one of the channels. Radially outwardly of the inner openings are a second plurality of openings 215*e*, 215*f*, 215*g* and 215*h*. Each of the openings 215*e–h* are arranged to communicate with more than one channel as can be seen with reference to 215*e* which communicates with adjacent channels 220*a*, 220*b* and 220*c*, i.e., the openings 215*e–h* are single openings each of which communicates with more than one fluid channel. In this way, each of the channels has its own source of fluid and the desired radial flow in achieved.

The form of bit 300 illustrated in FIG. 20 is a variant of that shown in FIG. 15, but incorporates the feature of a separate fluid opening for each channel. In this particular form, the total flow area has been reduced while the hydraulic horsepower per square inch has been increased and a larger pressure drop across the bit face has been achieved, with the effect that there has been an increase in fluid velocity. This particular form of hydraulics is of advantage in softer formations in which higher velocities tend to improve the cleaning. A secondary advantage is that it is possible to increase somewhat the number of cutters in the cone area.

In the form illustrated in FIG. 20, there are a plurality of channels 302 with lands or blades 305 on which cutters 310 are mounted, as already described. Some of the cutters are natural diamonds, as at 311 and 312. The fluid openings are in the form of a cruciform center opening 325 having a plurality of legs 326, the latter branching into two further legs 327 and 328. Each of the legs 327 and 328 feed directly to a channel as shown. Between spaced legs 326 there are curved openings 330, one being shown but four being used. Each of the curved openings includes spaced legs 330*a* and 330*b*, each of which feeds an associated channel. Located between legs 330*a* and 330*b* are two blades with a channel therebetween, the channel being fed by opening 340.

From FIG. 20, it can be seen that there are six blades between two adjacent legs of the cruciform opening, the latter including two further legs such that there are four blades between the facing further legs. Curved opening 330 has two blades between the legs, the two blades in turn having a channel which is fed by opening 340. In this way, the improved hydraulics is achieved and which has special advantages if the bit is used in the softer formations.

The bit of this invention has demonstrated good performance in mixed formations such as shale with hard stringers and sandstone or limestone with shale sections. The large area of the front cutting face, to some extent, acts as a chisel in cutting. In general, it is preferred to use triangular PCD elements of one carat size for resistance to balling in shale type formations, although any predetermined geometrical shape may be used. While reference has been made to drill bits, it is understood that within that term is included core bits and the like.

In crab orchard sandstone with a point loading of 50 lbs per cutter and at 150 RPM, the ROP was better than some of the prior art bits and about 24 feet per hour. As point loading per cutter was increased to 75 lbs, the ROP increased in the same formation and at the same RPM to 38 feet per hour.

It will also be apparent that even though the invention has been described principally with reference to drill bits, the present invention may also be used in core bits and the like.

It will be apparent to those skilled in the art that many modifications and alterations may be made in accordance with the above disclosure which is for purposes of illustration and is not to be viewed as a limitation on the present invention. The illustrated embodiments described in detail are for the purposes of example and should be considered as exemplary of the invention whose scope is defined in the following claims.

We claim:

1. A bit for use in earth boring and rotatable along an axis comprising:

a body member having a metal matrix curved surface which includes portions which include a flank, a shoulder and a nose which form a cutting surface, and including a gage, said cutting surface including a plurality of channels forming pad means of matrix material between adjacent channels, each said pad including a plurality of spaced synthetic polycrystalline diamond cutting elements mounted directly in the matrix during matrix formation, each of said cutting elements being of a predetermined geometrical shape and being temperature stable to at least about 1,200 degrees C., each of said cutting elements including a front face having a predetermined surface area and portions adjacent to said front face, at least some of the said cutting elements including a minor portion received within the matrix material of said pad and being so positioned that said one front face extends above the surface of said pad to form an exposed cutting face of said cutting element while at least two adjacent side portions are disposed such that one is adjacent to said pad and the other is spaced form said pad, said two adjacent side portions also having an exposed surface area, said exposed cutting face of at least those cutting elements, located in the flank and shoulder of said body, having an exposed surface area of said front face which is greater than one half of said predetermined surface area of said one front face, each of the said cutting elements including a surface portion generally to the rear of said cutting face, matrix material contacting at least a portion of the said surface portion to the rear of said cutting face to form a matrix backing to support said cutting element, said exposed surface area of the side portion of the cutting elements, which are located in said shoulder and flank and which is spaced from said pad, being greater than the surface area of the portion of said corresponding cutting element which is adjacent to said pad, and the exposed portion of each of said cutting elements extending more than 0.5 mm above the surface of said pad, all of said exposed surfaces of said element being thermally cooled by hydraulics, each of said plurality of cutting elements being spaced apart from adjacent ones of said cutting elements to allow free hydraulic access to all of said exposed surfaces, said plurality of cutting elements being arranged and configured in at least two radially distributed sequences, namely a first plurality of said cutting elements disposed in a first series of radially spaced-apart positions, and a second plurality of said cutting elements disposed in a second series of radially spaced-apart positions, said first and second series of cutting elements being radially offset one from the other so that at least one cutting element of said second series radially overlaps and is disposed azimuthally behind and radially between two corresponding cutting elements of said first series of cutting elements.

2. A bit as set forth in claim 1 further including passage means for flow of fluid to said channels, said channels being arranged in a radial pattern, and each of said channels including radial rib means therein for azimuthally directing flow of fluid to the face of said cutting elements adjacent to said channel.

3. A bit as set forth in claim 1 wherein the matrix material contacting the surface portion to the rear of said cutting face includes a flat pad.

4. A bit as set forth in claim 3 further including a trailing and sloping support to the rear of said flat pad.

5. A bit as set forth in claim 1 wherein said polycrystalline diamond cutting element is of a triangular geometric shape.

6. A bit as set forth in claim 1 wherein said polycrystalline diamond cutting element is a half cylinder.

7. A bit for use in earth boring and rotatable along an axis comprising:

a body member having an outer curved metal matrix surface, a plurality of spaced synthetic polycrystalline diamond prismatic cutting having at least one major surface and one minor surface, said major surface having a substantially greater area than said minor surface, said elements mounted directly in the matrix during matrix formation, each of said cutting elements being of a predetermined geometrical shape and being temperature stable to at least about 1,200 degrees C., each of said cutting elements including an exposed front face which includes said minor surface having a predetermined surface area and a longitudinal axis and portions adjacent to said front face, at least some of the said cutting elements including a small portion received within the matrix material and being so positioned that said front face extends above the matrix surface to form a cutting face of said cutting element while at least two adjacent side portions, which include said major surface, are disposed such that one is adjacent to said matrix and the other is spaced from said matrix, said two adjacent side portions being exposed, the total exposed cutting surface of at least some of the cutting elements having an exposed surface area which is greater than at least one half of the total surface area of the diamond prismatic cutting element, each of the said cutting elements including a surface portion generally to the rear of said cutting face, matrix material contacting at least a portion of the said surface portion to the rear of said cutting face to form a matrix backing to support said cutting element, at least some of said cutting elements being arranged in an orientation in which the longitudinal axis of said cutting face is generally parallel to the axis of rotation of said bit, the exposed surface area of the side portion of at least some of the cutting elements spaced from said matrix being greater than the exposed surface area of the portion of said corresponding cutting element which is adjacent to said matrix, each of said plurality of cutting elements being spaced apart from adjacent ones of said cutting elements to allow free hydraulic access to all of said exposed surfaces, said plurality of cutting elements being arranged and configured in at least two radially distributed sequences, namely a first plurality of said cutting elements disposed in a first series of radially spaced-apart positions, and a second plurality of said cutting elements disposed in a second series of radially spaced-apart positions, said first and second series of cutting elements being radially offset one from the other so that at least one cutting element of said second series radially overlaps and is disposed azimuthally behind and radially between two corresponding cutting elements of said first series of cutting elements;

the exposed portion of each of said cutting elements extending more than 0.5 mm above the surface of the matrix adjacent to said cutting elements, and means to effect flow of fluid over said matrix surface to cool and contact all exposed surfaces of said cutting elements and to remove the cuttings formed thereby.

8. A bit used for use in earth boring and rotatable along an axis comprising:

a body member having an outer curved metal matrix surface, a plurality of spaced synthetic polycrystalline diamond prismatic cutting elements mounted directly in the matrix in a stepped arrangement, each prismatic element characterized by a prismatic axis, said element having a major surface and a minor surface, said major surface being greater in area than said minor area and being substantially perpendicular to said prismatic axis, each of said cutting elements being temperature stable to at least about 1,200 degrees C., each of said cutting elements including an exposed front face including said minor surface having a predetermined surface area and portions adjacent to said front face, at least some of the said cutting elements including a small portion received within the matrix material and being so positioned that said front face extends above the matrix surface to form a cutting face of said cutting element while at least two adjacent side portions including said major surface are disposed such that one is adjacent to said matrix and the other is spaced from said matrix, said prismatic axis of said diamond cutting element being generally radial, said two adjacent side portions being exposed, each of the said cutting elements including a surface portion generally to the rear of said cutting face, matrix material contacting at least a portion of the said surface portion to the rear of said cutting face to form a matrix backing to support said cutting element, the exposed surface area of said side portion of at least some of the cutting elements spaced from said matrix being greater than the exposed surface area of the portion of said corresponding cutting element which is adjacent to said matrix, the exposed portion of each of said cutting elements extending more than 0.5 mm above the surface of the matrix adjacent to said cutting elements, and means to effect flow of fluid over said matrix surface to cool and contact all of said exposed surfaces of said cutting elements and to remove the cuttings formed thereby.

9. A rotatable bit as set forth in claim 8 wherein said matrix backing support means includes a pad means on the upper surface thereof which contacts the cutter element along the top portion thereof and to the rear thereof, wherein said pad extends across the full width of said cutting element.

10. A rotatable bit as set forth in claim 8 wherein said matrix backing support means includes an upper surface at least a portion of which is inclined, wherein said upper surface includes a pad to the rear of the cutter and an inclined portion to the rear of said pad.

11. A rotatable bit as set forth in claim 8 wherein said means to effect flow includes a plurality of spaced channels oriented generally radially with respect to the axis of rotation of said bit, wherein each of said channels includes radial rib means for conrolling the flow of fluid in said channels thereby azimuthally directing the flow of said fluid toward the cutting face of the adjacent cutters to maximize velocity of said flow.

12. A bit for use in earth boring with a gage and rotatable along an axis comprising:

a body member including an outer curved surface, a plurality of spaced cutting elements mounted in the said curved surface and extending thereabove for cutting the opposed formation, means located in said body for effecting flow of fluid from the interior of said body to the exterior thereof, said outer curved surface including a plurality of separated and radially extending channels to receive flow of fluid from said means in said body, each of said channels including radial rib means therein for azimuthally directing the flow of fluid in said channel from the trailing side of the preceding cutter elements to the cutting side of the cutting elements, and said rib means being a radial rib disposed in each of said channels, the thickness of said rib and depth of said channel varying from a minimum to a maximum as said gage of said bit is approached from the center of said bit.

13. An improvement in a rotating bit for use in earth boring, said bit including a body member having a matrix metal curved surface and a plurality of cutting teeth disposed on said surface, said plurality of teeth being provided with hydraulic fluid, each cutting tooth including at least one synthetic polycrystalline diamond prismatic element, said element being temperature stable to at least about 1200 degrees C., said prismatic element having at least one major surface and at least one minor surface, said major surface having an area greater than the area of said minor surface, said improvement comprising:

a tooth structure comprising said cutting tooth, said prismatic diamond element having said minor surface disposed within said tooth structure as a leading exposed cutting surface as defined by rotation of said bit, said minor surface including one edge embedded into said tooth structure, at least a portion of said tooth structure overlying said minor surface, adjacent surfaces to said minor surface including said major surface, said adjacent surfaces being substantially exposed and substantially freely accessible to thermal contact with said hydraulic fluid, a rear minor surface opposing said minor surface forming said leading cutting face being in contact with and backed by said tooth structure, and less than 40 percent of the total surface area of said synthetic polycrystalline diamond element being in contact with said tooth structure, the remaining portion of said diamond element being exposed.

14. The improvement of claim 13 wherein said prismatic diamond element is a triangular prismatic diamond element and said major surfaces being said triangular faces of said triangular prismatic element, said triangular prismatic element being disposed within said tooth structure with said triangular faces radialmost and exposed.

15. The improvement of claim 14 wherein said triangular prismatic element includes two opposing triangular faces and three side faces therebetween, said tooth structure completely contacting only two of said side faces.

16. The improvement of claim 15 wherein one of said side faces comprises said leading cutting face, only a lower edge portion of said side face being in contact with said tooth structure, said tooth structure overlying said portion of said side face comprising said leading cutting face.

17. The improvement of claim 13 further comprising a waterway disposed immediately in front of said tooth structure as defined by directional rotation of said bit, said waterway being substantially straight and radial and including a contoured channel, said contoured channel having a preferentially deeper trailing section longitudinally extending from the center of said bit radially outward to thereby azimuthally bias radial flow of fluid flowing within said channel backwardly toward said tooth structure.

18. The improvement of claim 17 wherein the depth of said channel and relative proportionate depth of said trailing portion of said channel increases as a function of radial position.

19. The improvement of claim 13 wherein more than 70 percent of synthetic polycrystalline diamond element within said tooth structure is exposed.

20. The improvement of claim 13 wherein said body member includes a plurality of raised lands, each said cutting tooth being disposed on one of said raised lands in said tooth structure, said diamond element being disposed entirely above said one raised land.

21. The improvement of claim 20 wherein said plurality of cutting elements are arranged and configured in at least two radially distributed sequences, namely a first plurality of said cutting elements disposed in a first series of radially spaced-apart positions, and a second plurality of said cutting elements disposed in a second series of radially spaced-apart positions, said first and second series of cutting elements being radially offset one from the other so that at least on cutting element of said second series radially overlaps and is disposed azimuthally behind and radially between two corresponding cutting elements of said first series of cutting elements.

22. The improvement of claim 13 wherein said plurality of cutting elements are arranged and configured in at least two radially distributed sequences, namely a first plurality of said cutting elements disposed in a first series of radially spaced-apart positions, and a second plurality of said cutting elements disposed in a second series of radially spaced-apart positions, said first and second series of cutting elements being radially offset one from the other so that at least one cutting element of said second series radially ovelaps and is disposed azimuthally behind and radially between two corresponding cutting elements of said first series of cutting elements.

* * * * *